US007149323B2

(12) United States Patent
Yamagishi

(10) Patent No.: US 7,149,323 B2
(45) Date of Patent: Dec. 12, 2006

(54) SPEAKER

(75) Inventor: Kiyoshi Yamagishi, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 315 days.

(21) Appl. No.: 10/257,266

(22) PCT Filed: Aug. 6, 2001

(86) PCT No.: PCT/JP01/06730

§ 371 (c)(1),
(2), (4) Date: Mar. 10, 2003

(87) PCT Pub. No.: WO02/065811

PCT Pub. Date: Aug. 22, 2002

(65) Prior Publication Data

US 2004/0062146 A1 Apr. 1, 2004

(30) Foreign Application Priority Data

Feb. 13, 2001 (JP) ..... 2001-034918

(51) Int. Cl.
*H04R 25/00* (2006.01)

(52) U.S. Cl. ..... 381/415; 381/412; 381/420

(58) Field of Classification Search ..... 381/415, 381/403, 404, 405, 411–412, 413, 420, 396–398, 381/400, 401, 407, 414; 29/609.1, 594; 335/49, 335/47, 222, 223

See application file for complete search history.

(56) References Cited

U.S. PATENT DOCUMENTS 3,660,618 A * 5/1972 White ..... 381/420
3,747,204 A * 7/1973 Beavers ..... 29/594
4,235,302 A * 11/1980 Tsukamoto ..... 381/398
4,320,263 A * 3/1982 Thiele ..... 381/415
4,414,437 A * 11/1983 Trauernicht et al. ..... 381/415
4,694,213 A 9/1987 Gowda et al.
5,255,328 A * 10/1993 Akiniwa et al. ..... 381/398
5,335,287 A * 8/1994 Athanas ..... 381/415
5,704,613 A * 1/1998 Holtkamp ..... 277/302
5,757,946 A * 5/1998 Van Schyndel ..... 381/412

FOREIGN PATENT DOCUMENTS

JP 63-196199 12/1968
JP 65882 2/1975
JP 16892 9/1981

* cited by examiner

*Primary Examiner*—Huyen Le
(74) *Attorney, Agent, or Firm*—Wenderoth, Lind & Ponack, L.L.P.

(57) ABSTRACT

A speaker comprising: a magnetic circuit provided with a through hole, and a recess formed around the through hole for retaining a magnetic fluid. The speaker further comprises a bearing provided in the through hole and a shaft supported by the bearing to be movable up and down and fixed to a center cap fixed to a voice coil. A gap between the bearing and the shaft is filled with the magnetic fluid. The speaker eliminates a damper, and realizes a very low $f_0$ which has not been obtained before. Furthermore, the magnetic fluid absorbs friction and resonance between the bearing and the shaft, and the magnetic fluid is kept in the recess and is supplied smoothly into the gap between the shaft and the bearing. Thus, generation of abnormal sounds is suppressed and a large amplitude operation is realized in the speakers of the present invention.

17 Claims, 9 Drawing Sheets

FIG. 7 – PRIOR ART
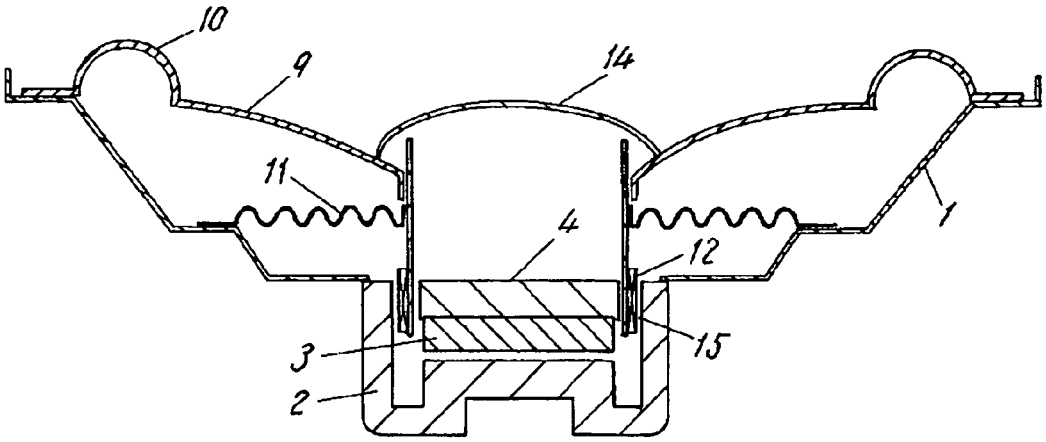

FIG. 8 – PRIOR ART
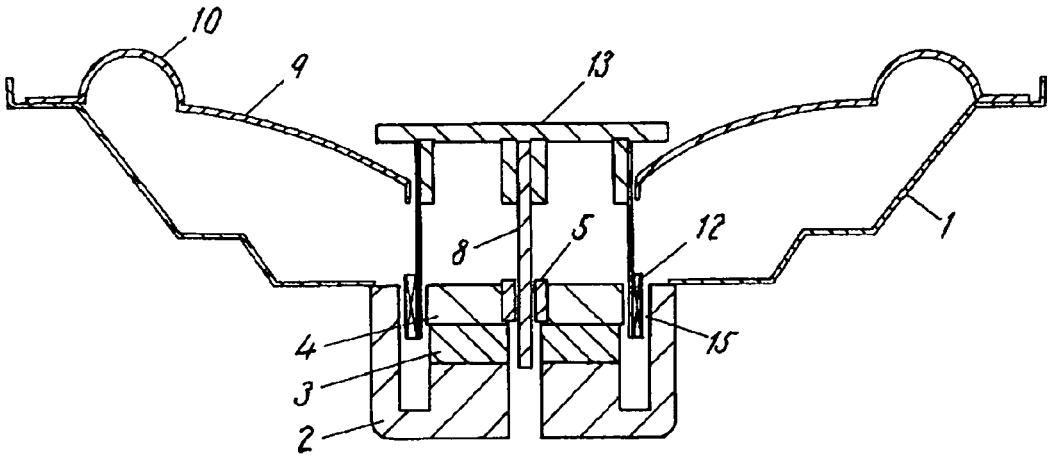

Reference Numrals

| | |
|---|---|
| 1 | Frame |
| 2a | Yoke |
| 2b, 12b | Through hole |
| 3a | Magnet |
| 4a | Top plate |
| 5, 5a, 5b | Bearing |
| 6 | Recess |
| 7 | Magnetic fluid |
| 8 | Shaft |
| 9 | Diaphragm |
| 10 | Edge |
| 12 | Voice coil |
| 13 | Center cap |
| 14 | Dust cap |
| 15 | Magnetic gap |
| 16 | Bearing cover |
| 17 | Bobbin |
| A | Magnetic circuit |

SPEAKER

TECHNICAL FIELD

The present invention related to a loudspeaker for use in various kinds of sound apparatus.

BACKGROUND ART

A conventional loudspeaker (hereinafter "speaker") technology is described referring to FIG. 7, a cross sectional view of a speaker. FIG. 8 shows a cross sectional view of another conventional speaker. A conventional speaker of FIG. 7 comprises a frame 1, a yoke 2, a magnet 3, a top plate 4, a diaphragm 9, an edge 10, a damper 11, a voice coil 12, a dust cap 14 and a magnetic gap 15. The main objective of the edge 10 is to hold the diaphragm 9 at a center portion and to close a cavity behind the diaphragm 9, while that of damper 11 is to keep the diaphragm 9 at the center and to control the lowest resonance frequency (hereinafter referred to as "$f_0$") by making use of the damper's flexibility.

The higher the flexibility of damper 11, the higher the flexibility of the speaker as a whole, and the lower $f_0$ becomes. Since the lowest frequency a speaker can reproduce is substantially determined by $f_0$, specifying a flexibility for damper 11 is one of the key factors in designing the sound reproduction characteristics in a low frequency range.

As a result of expanded reproduction frequency range brought about as a result of recent progress in the digital technologies, the speakers are required to be able to reproduce still lower frequency sounds. Some of the speakers are requested to provide a low $f_0$ that did not exist before.

If in a conventional speaker the flexibility of the damper 11 is increased with the aim of simply lowering $f_0$, the capability of the damper to keep the diaphragm at the center becomes weak and a supporting state of the vibration system becomes unstable. Under such a state, the vibration system readily causes a rolling motion, which makes the voice coil 12 physically contact with yoke 2 or top plate 4 in the magnetic gap and generate abnormal noise or deteriorated sound. In the worst case, it leads to a breakdown of the voice coil 12 and vibration system.

A speaker proposed to solve the above-described problems is described referring to FIG. 8. Only the differences from the one illustrated in FIG. 7 are described. The improved speaker as shown in FIG. 8 further comprises a bearing 5, a shaft 8 and a center cap 13, besides the conventional constituent elements. The shaft 8 is fixed to the center cap 13 at the center, the center cap being fixed on the upper end of a voice coil bobbin. The shaft 8 is supported by the bearing 5 fixed in a through hole formed in a magnetic circuit. Namely, the vibration system is supported by the shaft 8, instead of the damper 11 used in the speaker of FIG. 7. An elimination of damper 11 results in an advantage that is equivalent to an extremely flexible damper 11, while the centering of the vibration system is well maintained.

In the conventional speaker as shown in FIG. 8, however, there exists friction between the shaft 8 and the bearing 5, and resonance occurs in a gap between the shaft 8 and the bearing 5. The resonance is transferred via shaft 8 to the diaphragm 9, and magnified to cause an abnormal sound. In order to prevent such drawbacks, a countermeasure, for example, inserting a sound absorbing material between the shaft 8 and the diaphragm 9, needs to be provided. However, the countermeasure impairs rigid supporting of the shaft 8; more importantly, it cannot prevent generation of abnormal sounds completely.

The present invention addresses the drawbacks of the conventional speakers, and aims to provide a speaker in which an abnormal sound is suppressed and the vibration system can move at great amplitudes.

DISCLOSURE OF THE INVENTION

A speaker of the present invention comprises a through hole provided in a magnetic circuit, and a recess formed around the through hole for preserving a magnetic fluid. The speaker of the present invention further comprises a bearing disposed in the through hole, and a shaft fixed to a center cap which is fixed to a voice coil, the shaft being supported by the bearing to be movable up and down in the bearing. A gap between the bearing and the shaft is filled with a magnetic fluid.

The speaker in which damper has a damper has eliminated, is equivalent to a speaker that has a damper of extremely high flexibility. So, the speaker realizes a low $f_0$ that could not be obtained before. Further, the magnetic fluid absorbs friction and resonance generated between the bearing and the shaft, and the recess contains the magnetic fluid to ensure a continuous supply to the gap between the shaft and the bearing. Therefore, the speaker suppresses generation of abnormal sounds and allows the vibration system to move in great amplitudes.

In a speaker in claim 2 of the present invention, the yoke is provided with a recess formed adjacent to a through hole in a surface at the magnet side. With this configuration, a bearing length in a top plate can be determined without restriction so that the shaft is supported in a stable manner with respect to the direction of thrust motion.

In a speaker of the present invention, the top plate is provided with a recess formed nearby a through hole in a surface at the magnet side. With this configuration, a magnetic fluid is kept in a location adjacent to a bearing so that the magnetic fluid is smoothly supplied to the bearing.

A speaker of the present invention is further provided with a damper in addition to the above-described structures of the present invention. This configuration prevents a leap phenomenon at great amplitudes and improves symmetrical vibration between the up-side and down-side amplitudes, which drawbacks are beyond the control of a combination of only the shaft and the bearing, although the configuration might be slightly inferior in flexibility to a speaker with no damper.

A speaker of the present invention is further provided with a bearing cover disposed around the through hole on the upper surface of the top plate. This configuration prevents the magnetic fluid from spreading over a surface of magnetic circuit and sneaking into the magnetic gap.

In a speaker of the present invention, the bearing for supporting the shaft is provided with a bearing portion whose inner diameter is larger than the diameter of a shaft. In this configuration, the bearing portion having a larger inner diameter is used for preserving the magnetic fluid. So, the magnetic fluid can be delivered to the bearing in a more stable manner. Thus, a length of the bearing which supports the shaft can be made shorter to reduce frictional resistance with the shaft, while maintaining enough overall length for rigidly holding the bearing in an external structure.

BRIEF DESCRIPTION OF THE DRAWINGS

FIG. 7 is a cross-sectional view of a conventional speaker.

FIG. 8 is a cross-sectional view of an improved conventional speaker.

BEST MODE FOR CARRYING OUT THE INVENTION

Figure 1:
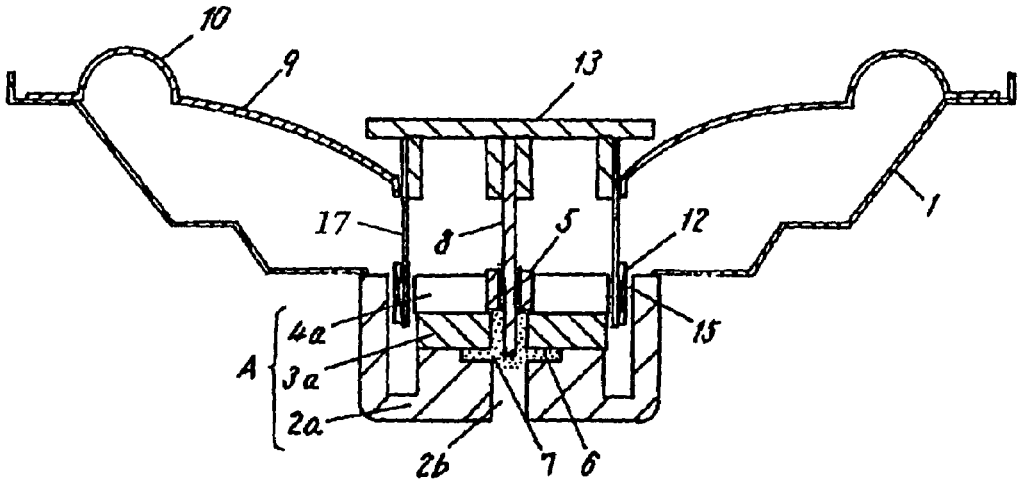
FIG. 1 is a cross-sectional view of a speaker in accordance with an exemplary embodiment of the present invention.

Speakers in accordance with exemplary embodiments of the present invention are described referring to drawing FIG. 1 through FIG. 6. Those parts identical to those in the conventional technology are represented by using the same reference numerals, and description of such parts is omitted.

First Embodiment

Figure 2:
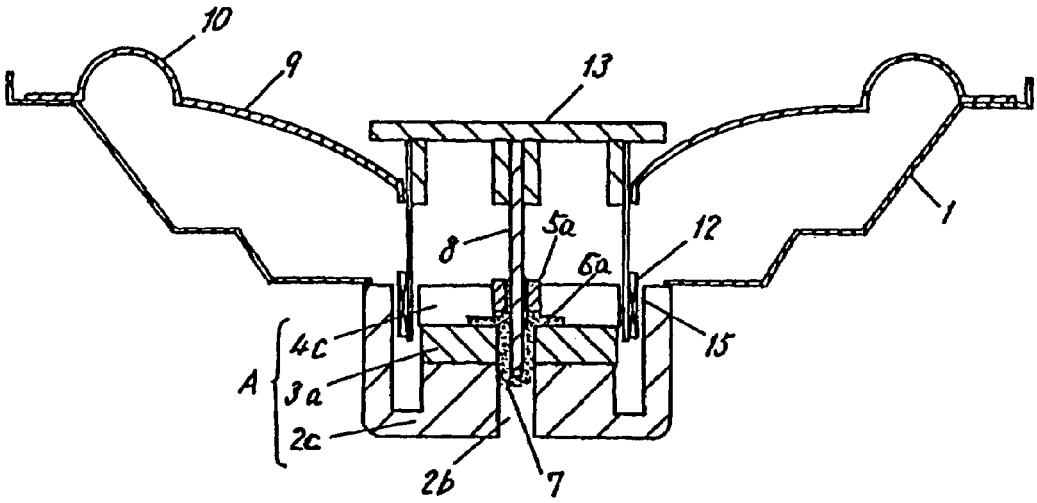
FIG. 2 is a cross-sectional view of a speaker in a modified example.

A speaker in accordance with an exemplary embodiment of the present invention is described referring to FIG. 1 and FIG. 2.

In a speaker of the present invention, an inner magnet type magnetic circuit A is formed of a yoke 2*a*, a magnet 3*a* and a top plate 4*a*, and the magnetic circuit is provided with a through hole 2*b* at the center, as shown in FIG. 1. A frame 1 is fixed on the yoke 2*a* of magnetic circuit A. A diaphragm 9 and an edge 10 are fixed on the frame 1. A bobbin 17 of a voice coil 12 is fixed to an inner circumference of the diaphragm 9, and the voice coil 12 is supported in a magnetic gap 15 formed by the yoke 2*a* and the top plate 4*a*. A center cap 13 is fixed on the bobbin 17 at the top edge, so as to be coaxial with the axis of the bobbin 17.

A bearing 5 is fixed to be coaxial with the axis of the through hole 2*b*. A shaft 8 is fixed at the top end to a center of the center cap 13, and supported by the bearing 5 so that it can move up and down.

The yoke 2*a* is provided, in its surface making contact with the magnet 3*a*, with a recess 6 formed around the through hole 2*b*. The diameter of the recess 6 is larger than that of the through hole 2*b*. Since the recess 6 is a gap formed in a field of a magnetic circuit, the density of magnetic flux at recess 6 is higher than that in the rest of the through hole 2*b*. Therefore, a magnetic fluid 7 injected in the vicinity of the bearing 5 is kept in the recess 6; it does not escape through the through hole 2*b*. The magnetic fluid 7 is thus preserved in the recess 6 to be continuously supplied to the gap formed between the bearing 5 and the shaft 8 accompanied by the up and down motion of the shaft 8.

The recess may be provided by spot facing the yoke material around the center of the through hole, or by pressing the yoke material simultaneously when forming the yoke, or by a separate pressing process. It is easiest to provide a recess in a round shape from the view point of the machining process. However, the shape of the recess is not limited to a round shape.

In the present embodiment, since the recess 6 is formed in a surface of the yoke 2 at a magnet side, a length of the bearing 5 in the top plate 4*a* can be any desired length.

FIG. 2 shows a speaker in a modified example of the present embodiment. In this speaker a recess 6*a* is provided around a through hole 2*b* in the top plate 4*c* on the surface at the magnet 3*a* side.

By appropriately adjusting the length of a bearing 5*a* so that it does not block the recess 6*a*, as illustrated in FIG. 2, the magnetic fluid 7 can be preserved in a location adjacent to the bearing 5*a*. With this configuration, the magnetic fluid 7 is supplied to the bearing 5*a* smoothly.

With the above-configured speaker having a 12 cm diameter, for example, it has been confirmed that an $f_0$ of lower than 30 Hz can be obtained, whereas with a conventional speaker the $f_0$ is approximately 60 Hz at its lowest. Also the friction sound and the resonance sound caused by the bearing 5*a* and the shaft 8 are completely eliminated in the speaker of the present invention. Thus a speaker which exhibits a stable performance even at great amplitudes is provided.

Second Embodiment

Figure 3:
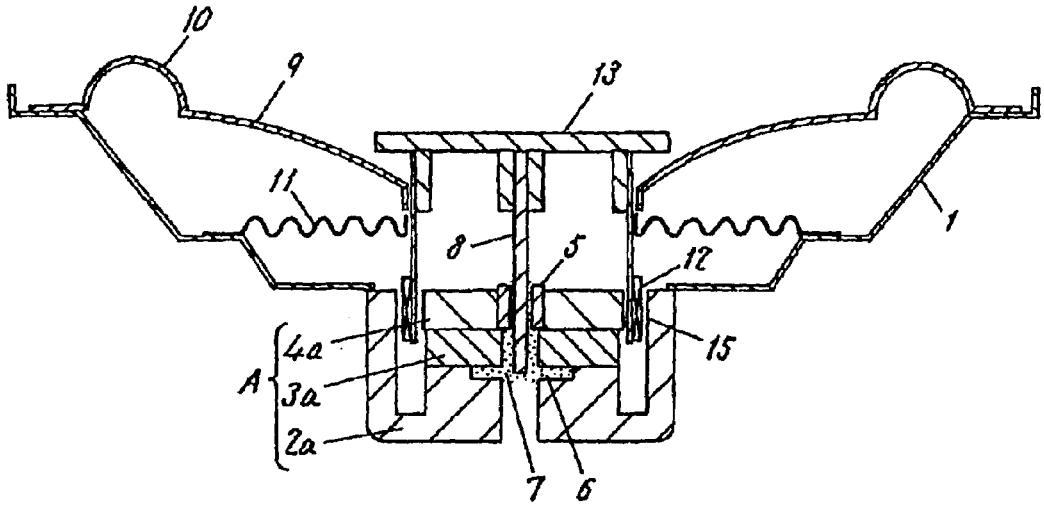
FIG. 3 is a cross-sectional view of a speaker in accordance with another exemplary embodiment of the present invention.
Figure 4:
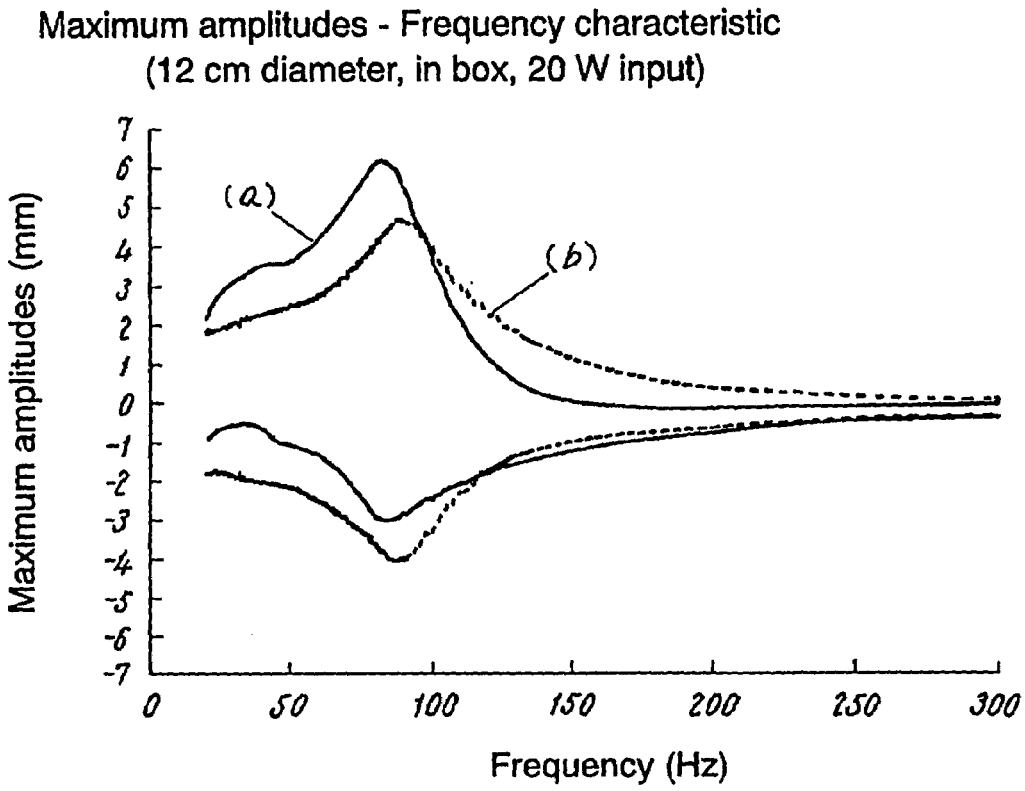
FIG. 4 is a characteristics chart showing an input sine wave frequency versus a maximum value in up-and-down amplitudes of the speaker.

A speaker in accordance with a second exemplary embodiment of the present invention is described referring to FIG. 3 and FIG. 4. Description is made focusing on a point of difference from the first embodiment.

FIG. 3 is a cross-sectional view of a speaker in the present embodiment, while FIG. 4 is a characteristics chart showing a relation between maximum amplitudes and frequency characteristics. As FIG. 3 shows, the speaker of the present embodiment is provided with a damper 11, which is fixed at the outer circumference to the frame 1 and at the inner circumference to the voice coil 12. In the speaker of the first embodiment, where a damper is eliminated, the vibration system is provided with full flexibility; however, the up and down motion is not controlled until the edge 10 is expanded to its full length. So, a leap phenomenon or a distortion due to asymmetry among the up-side and down-side amplitudes can readily occur. The configuration in the present embodiment addresses the above drawbacks, and aims to provide a speaker which operates in a more stable manner with a lower distortion.

A preferred property of the damper 11 here is a high amplitude linearity during normal operation, while it gradually suppresses the amplitudes when a large input that moves the voice coil 12 out of magnetic gap 15 is applied. Since the damper 11 in the present embodiment is not expected to function to keep a vibration system at a center, it is easy to provide the damper with high flexibility for maintaining the $f_0$ at a low level.

A 12 cm diameter speaker in the present embodiment 2 is mounted in a box to be measured with respect to "input sine wave frequency" versus "maximum up-down amplitudes", and the results are shown in FIG. 4. In FIG. 4, a curve (a) represents a speaker in the first embodiment, while a curve (b) represents a speaker in present embodiment 2. As seen in FIG. 4, the curve (b) shows a stable change in amplitude and a significantly improved symmetry among the up and down amplitudes, as compared with the curve (a), or characteristics in the first embodiment. Thus the advantage of the present embodiment 2 has been confirmed.

Third Embodiment

Figure 5:
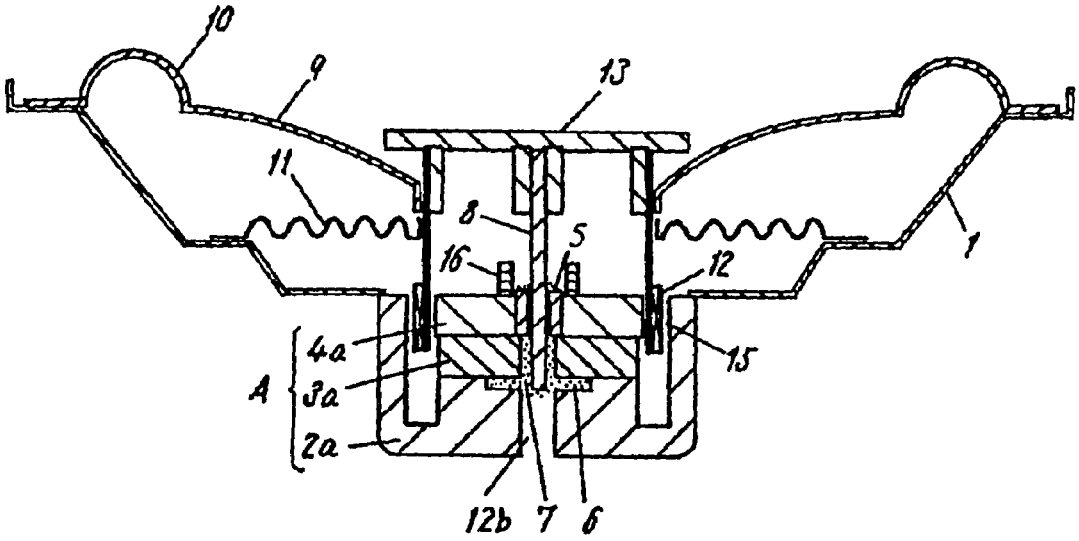
FIG. 5 is a cross-sectional view of a speaker in accordance with still another exemplary embodiment of the present invention.
Figure 6:
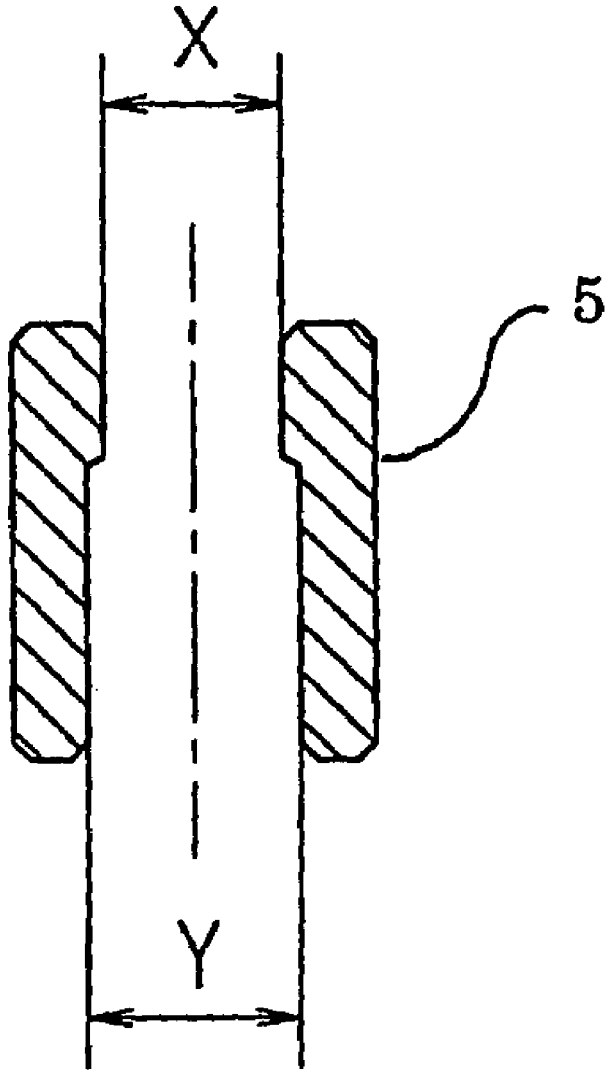
FIG. 6 is a cross-sectional view of a bearing, which is a key part of the speaker.

FIG. 5 is a cross-sectional view of a speaker in accordance with a third exemplary embodiment of the present invention. FIG. 6 shows a cross-sectional view of the key part, or a bearing. In the following, the differences from the first and the second embodiments are described.

As shown in FIG. 5, the difference from the first embodiment is that a speaker in the present embodiment 3 is provided with a bearing cover 16 surrounding the bearing 5, which is disposed on the upper surface of the top plate 4*a* in a location around the through hole 12*b*. In case magnetic fluid 7 is pushed out from the top end of bearing 5, it might be pulled into the magnetic gap 15 if the bearing cover 16 is not provided. If the magnetic fluid 7 is pulled into the magnetic gap 15 in volume, it would clog the magnetic gap 15 to generate abnormal sound. Or, the gap between bearing 5 and shaft 8 might be short of magnetic fluid 7, which also would cause abnormal sound. The present embodiment addresses the above problems and aims to improve the reliability, by blocking outgoing flow of the magnetic fluid 7 with the bearing cover 16.

Since the flow of magnetic fluid 7 blocked by bearing cover 16 is always under the influence of a horizontal pulling force of magnetic gap 15, the magnetic fluid 7 is preserved inside the bearing cover 16 on the bottom and part of it is delivered again into the bearing 5 as a result of up and down motion of shaft 8. Therefore, a preferred height of the bearing cover 16 is 1 mm or higher. Preferred material for the bearing cover 16 is a non-magnetic material, in view of leakage of the magnetic flux and the ease of assembly.

As described above, a speaker in the present embodiment is provided with a double safety means against a possible outflow of magnetic fluid 7; namely, the bearing cover 16 in addition to the recess 6 having a high magnetic flux density. Thus additional reliability is provided in the present embodiment.

Furthermore, the bearing 5 is formed to have a portion whose inner diameter is X, and another portion whose inner diameter is Y which is larger than X, as illustrated in FIG. 6. The portion having inner diameter X supports the shaft 8, while the other portion having inner diameter Y provides a certain appropriate gap against shaft 8. Thus, the length of bearing which supports a shaft can be made shorter to reduced frictional resistance with the shaft 8, while maintaining overall length sufficient for rigidly mounting a bearing 5 in an external structure.

Still further, the portion of inner diameter Y containing the magnetic fluid 7 contributes to a smoother supply of the magnetic fluid 7 to the bearing.

According to experimental results, an appropriate difference between the inner diameter X and the inner diameter Y is 0.1 mm–0.5 mm.

INDUSTRIAL APPLICABILITY

In a speaker of the present invention, a shaft supported to be movable in up and down directions by a bearing holds the voice coil via a center cap, and a magnetic fluid is supplied between the bearing and the shaft. The speaker having the above-described configuration provides a low $f_0$, and operates with stable performance without any accompanying abnormal sound. Thus the present invention provides a speaker which radiates sound of improved quality, in which a reproduction frequency of a low frequency range sound has been expanded and distortion is reduced.

What is claimed is:

1. A speaker comprising:

a magnetic circuit provided with a magnetic gap, a through hole and a recess surrounding said through hole, said recess being formed with a diameter larger than a diameter of said through hole and being disposed radially outwardly of said through hole;

a frame fixed on said magnetic circuit;

a diaphragm having an outer periphery fixed to said frame;

a voice coil supported in said magnetic gap;

a center cap fixed on a top end of a voice coil bobbin fixed to said diaphragm;

a bearing provided in said through hole; and a shaft supported by said bearing so as to be movable up and down, said shaft being fixed to said center cap;

wherein said magnetic circuit comprises a yoke having a magnet mounting surface, a magnet mounted on said magnet mounting surface of said yoke, and a top plate having a magnet mounting surface mounted on said magnet;

wherein said recess is formed adjacent to said through hole in said magnet mounting surface of one of said yoke and said top plate so as to extend only part way through said one of said yoke and said top plate;

wherein a magnetic fluid is retained in said recess and in said through hole around said shaft; and wherein said recess is contiguous with said through hole, so as to be in fluid communication with said through hole.

2. The speaker of claim 1, further comprising a damper, an inner periphery of said damper being fixed to said voice coil bobbin and an outer periphery of said damper being fixed to said frame.

3. The speaker of claim 2, wherein said top plate is provided with a bearing cover disposed around said through hole.

4. The speaker of claim 3, wherein said bearing is provided with a first inner diameter for supporting said shaft, and a second inner diameter larger than said first inner diameter.

5. The speaker of claim 2, wherein said bearing is provided with a first inner diameter for supporting said shaft, and a second inner diameter larger than said first inner diameter.

6. The speaker of claim 1, wherein said top plate is provided with a bearing cover disposed around said through hole.

7. The speaker of claim 6, wherein said bearing is provided with a first inner diameter for supporting said shaft, and a second inner diameter larger than said first inner diameter.

8. The speaker of claim 1, wherein said bearing is provided with a first inner diameter for supporting said shaft, and a second inner diameter larger than said first inner diameter.

9. A speaker comprising:

a magnetic circuit arrangement including a yoke having a magnet mounting surface and a magnetic gap-defining wall, a magnet mounted on said magnet mounting surface of said yoke, and a top plate having a magnet mounting surface mounted on said magnet, said magnet and said top plate being mounted on said magnet mounting surface of said yoke so as to face said magnetic gap-defining wall of said yoke across a magnetic gap;

a frame fixed on said magnetic circuit arrangement;

a diaphragm having an outer peripheral portion fixed to said frame, a voice coil supported in said magnetic gap, a through hole formed in said top plate, said magnet, and said magnet mounting surface of said yoke;

a bearing provided in said through hole;

a shaft supported by said bearing so that said shaft is movable in a direction in and out of said through hole; and a center cap fixed to said shaft for movement therewith, and an inner peripheral portion of said diaphragm being fixed for movement with said center cap;

wherein a recess is formed adjacent to and about said through hole in said magnet mounting surface of one of said yoke and said top plate so as to extend only part way through said one of said yoke and said top plate, said recess having a large diameter than said through hole and being disposed radially outwardly from said through hole;

wherein a magnetic fluid is retained is said recess and in said through hole around said shaft; and wherein said recess is contiguous with said through hole, so as to be in fluid communication with said through hole.

10. The speaker of claim 9, further comprising a voice coil bobbin having said voice coil mounted thereon;

wherein said center cap is fixed to said voice coil bobbin; and wherein said voice coil bobbin is fixed to said diaphragm.

11. The speaker of claim 10, further comprising a damper, an inner periphery of said damper being fixed to said voice coil bobbin and an outer periphery of said damper being fixed to said frame.

12. The speaker of claim 11, wherein said bearing is provided with a first inner diameter for supporting said shaft, and a second inner diameter larger than said first inner diameter.

13. The speaker of claim 11, wherein said top plate is provided with a bearing cover disposed around said through hole.

14. The speaker of claim 13, wherein said bearing is provided with a first inner diameter for supporting said shaft, and a second inner diameter larger than said first inner diameter.

15. The speaker of claim 9, wherein said top plate is provided with a bearing cover disposed around said through hole.

16. The speaker of claim 15, wherein said bearing is provided with a first inner diameter for supporting said shaft, and a second inner diameter larger than said first inner diameter.

17. The speaker of claim 9, wherein said bearing is provided with a first inner diameter for supporting said shaft, and a second inner diameter larger than said first inner diameter.

* * * * *

UNITED STATES PATENT AND TRADEMARK OFFICE

CERTIFICATE OF CORRECTION

PATENT NO. : 7,149,323 B2
APPLICATION NO. : 10/257266
DATED : December 12, 2006
INVENTOR(S) : Kiyoshi Yamagishi It is certified that error appears in the above-identified patent and that said Letters Patent is hereby corrected as shown below:

In the Claim

Column 6, line 59, please change "said frame," to --said frame;--.

Column 6, line 60, please change "magnetic gap," to --magnetic gap;--.

Column 7, line 11, please change "retained is said" to --retained in said--.

Signed and Sealed this

Twenty-seventh Day of March, 2007

JON W. DUDAS
*Director of the United States Patent and Trademark Office*